US011584603B2

(12) United States Patent
Takahashi

(10) Patent No.: US 11,584,603 B2
(45) Date of Patent: Feb. 21, 2023

(54) SHEET STORAGE DEVICE AND IMAGE FORMING APPARATUS

(71) Applicant: CANON KABUSHIKI KAISHA, Tokyo (JP)

(72) Inventor: Ryosuke Takahashi, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 50 days.

(21) Appl. No.: 17/100,346

(22) Filed: Nov. 20, 2020

(65) Prior Publication Data

US 2021/0070577 A1 Mar. 11, 2021

Related U.S. Application Data

(63) Continuation of application No. 16/225,440, filed on Dec. 19, 2018, now Pat. No. 10,865,063.

(30) Foreign Application Priority Data

Dec. 27, 2017 (JP) ..... JP2017-252538

(51) Int. Cl.

| | |
|---|---|
| ***B65H 29/14*** | (2006.01) |
| ***B65H 31/26*** | (2006.01) |
| ***G03G 15/00*** | (2006.01) |
| ***B65H 29/52*** | (2006.01) |
| ***B65H 1/04*** | (2006.01) |

(52) U.S. Cl.

CPC ..... *B65H 29/14* (2013.01); *B65H 1/04* (2013.01); *B65H 29/52* (2013.01); *B65H 31/26* (2013.01); *G03G 15/6538* (2013.01); *B65H 2301/4212* (2013.01); *B65H 2405/111* (2013.01); *G03G 2215/00421* (2013.01)

(58) Field of Classification Search

CPC ..... B65H 2405/121; B65H 2405/142; B65H 2405/114; B65H 31/20; B65H 2405/35; B65H 2403/411

See application file for complete search history.

(56) References Cited

U.S. PATENT DOCUMENTS 6,254,086 B1 * 7/2001 Sunou ..... B65H 1/04 271/171
2006/0022397 A1 * 2/2006 Kaneko ..... B65H 31/20 271/145

* cited by examiner

*Primary Examiner* — Howard J Sanders
(74) *Attorney, Agent, or Firm* — Canon U.S.A., Inc. IP Division

(57) ABSTRACT

There is provided a sheet storage device including a regulation unit that includes a first contact portion configured to contact a stacking unit, and a second contact portion configured to contact a facing member. The first contact portion contacts the stacking unit in a state of being urged toward the stacking unit. The second contact portion contacts the facing member in a state of being urged toward the facing member.

11 Claims, 11 Drawing Sheets

SHEET STORAGE DEVICE AND IMAGE FORMING APPARATUS

CROSS REFERENCE OF RELATED APPLICATIONS

This application is a Continuation of U.S. patent application Ser. No. 16/225,440, filed Dec. 19, 2018, which claims the benefit of Japanese Patent Application No. 2017-252538, filed Dec. 27, 2017, all of which are hereby incorporated by reference herein in their entirety.

BACKGROUND

Field

The present disclosure relates to a sheet storage device for storing sheets, and an image forming apparatus having the sheet storage device.

Description of the Related Art

There are some conventional image forming apparatuses provided with a regulation unit on the sheet stacking face of a sheet feeding unit. The regulation unit is disposed movable in the width direction to set the sheet position at a predetermined position in the width direction perpendicularly intersecting with the sheet conveyance direction. To hold the sheet position in the width direction, the regulation unit is configured so as to act a predetermined retention force between an apparatus main body and the regulation unit. As a method for providing the retention force, for example, an elastically deformable contact shape formed of such a material as synthetic resin is urged to the apparatus main body to generate a frictional force so that a predetermined pressure is generated. The regulation unit is provided with a guided portion, and the apparatus main body is provided with a guide hole. The guide hole is formed in an oblong shape along the width direction, and the guided portion is inserted into the guide hole. When the regulation unit is operated, the guided portion can move in the width direction while being guided by the guide hole and rubbing the guide hole.

In a configuration discussed in Japanese Patent Application Laid-Open No. 7-101561, a regulation unit may incline depending on an operated position when the regulation unit is operated. In this case, since a guided portion obliquely rubs a guide hole, frictional force can occur.

SUMMARY

According to an aspect of the present invention, a sheet storage device includes an apparatus main body, a stacking unit disposed on the apparatus main body and configured to stack sheets to be stored, a regulation unit configured to move with respect to the apparatus main body, and to regulate edge positions of the sheets to be stacked on the stacking unit, and a facing member disposed on the apparatus main body, at a position facing the stacking unit across the regulation unit, wherein the regulation unit includes a first contact portion configured to contact the stacking unit in a state of being urged toward the stacking unit, and a second contact portion configured to contact the facing member in a state of being urged toward the facing member.

Further features of the present invention will become apparent from the following description of exemplary embodiments with reference to the attached drawings.

DESCRIPTION OF THE EMBODIMENTS

Exemplary embodiments will be described as illustrative in detail below with reference to the accompanying drawings. However, sizes, materials, shapes, and relative arrangements of constituent parts described in the exemplary embodiments are not limited thereto and are to be modified as required depending on the configuration of an apparatus according to the exemplary embodiments and other various conditions. The scope of the present invention is not limited to the exemplary embodiments described below.

An exemplary embodiment will be described below centering on an electrophotographic image forming apparatus having one attachable and detachable process cartridge, as an example of an image forming apparatus. However, the number of process cartridges to be attached is not limited thereto and suitably set as required. For example, in a case of an image forming apparatus for forming a full color image, four process cartridges are attached. Although the following exemplary embodiments will be described below centering on a printer as an example of an image forming apparatus, the image forming apparatus is not limited thereto. The present disclosure is also applicable to other image forming apparatuses including a copying machine, a facsimile machine, and a multifunction peripheral including combined functions of these apparatuses.

<Descriptions of Overall Configuration of Image Forming Apparatus>

Figure 1:
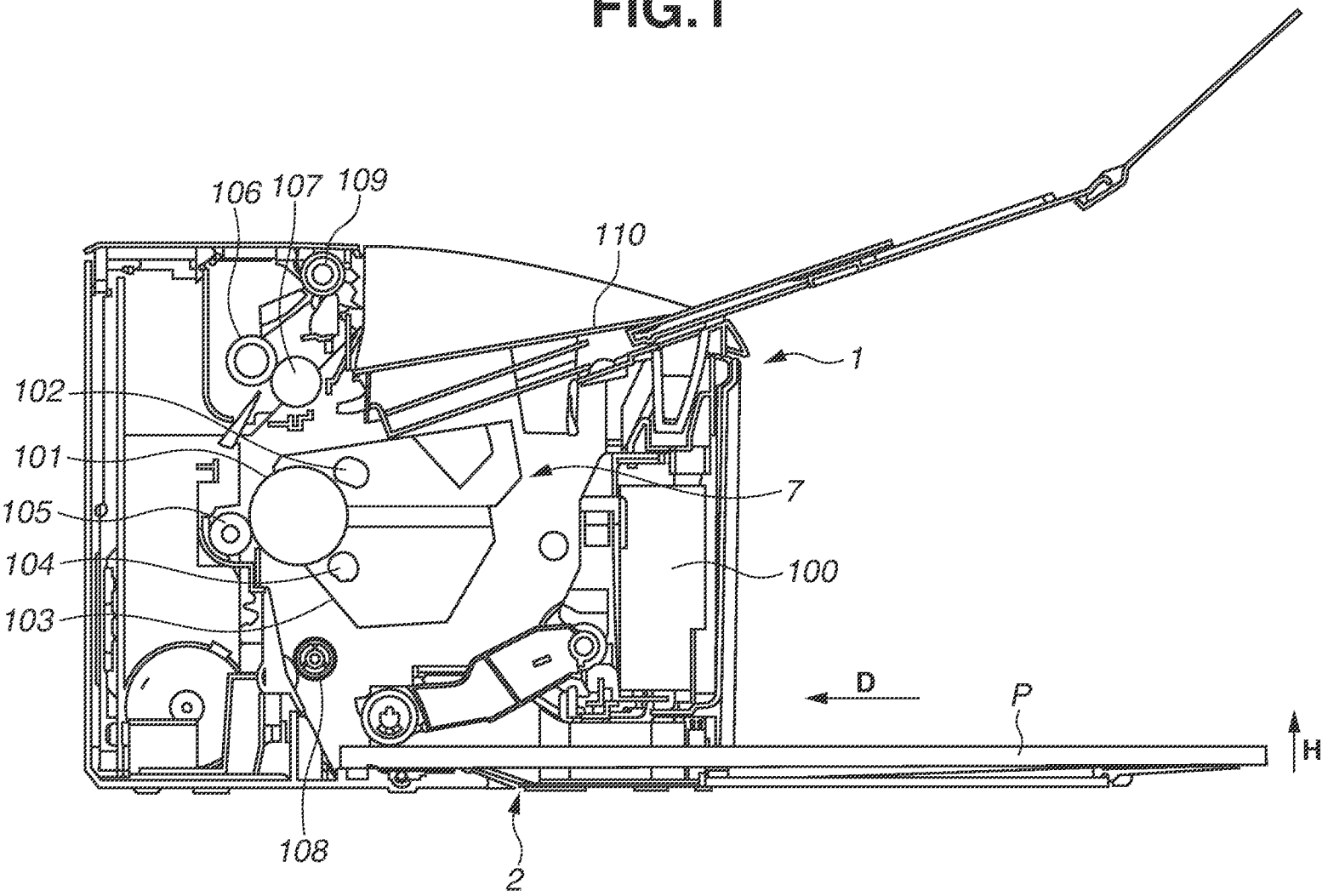
FIG. 1 is a cross-sectional view schematically illustrating an overall configuration of an image forming apparatus according to a first exemplary embodiment.

FIG. 1 is a cross-sectional view schematically illustrating an overall configuration of an image forming apparatus according to a first exemplary embodiment. An image forming apparatus 1 (apparatus main body 1) includes a process cartridge 7 as an image forming unit. The process cartridge 7 includes a drum-like electrophotographic photosensitive member (photosensitive drums) 101.

The photosensitive drum 101 is uniformly charged to a predetermined polarity and potential by a charging roller 102, and then subjected to image exposure by an image exposure unit 100. Then, an electrostatic latent image corresponding to a target image is formed. Subsequently, at a development position, the electrostatic latent image is developed, by a developing roller 104 included in a development unit 103, to be visualized as a toner image.

When the toner image formed on the photosensitive drums 101 passes through transfer portion formed by the photosensitive drum 101 and a transfer roller 105, the toner image is transferred onto a recording medium (sheet) P that is conveyed by a conveyance unit 108 included in a conveyance apparatus 2. The image forming apparatus 1 according to the present exemplary embodiment is partly formed of the conveyance apparatus 2. The direction of an arrow D illustrated in FIG. 1 indicates the feeding direction (conveyance direction) according to the first exemplary embodiment.

The sheet P with the toner image transferred thereon at the transfer portion is subjected to fixing processing by a fixing unit including a fixing roller 106 and a heating member 107. Then, the toner image is fixed to the sheet P. More specifically, when the sheet P is being conveyed between the fixing roller 106 and the heating member 107 of the fixing unit, the toner image is melted by the heat of the heating member 107 and then fixed to the surface of the sheet P. Then, the sheet P is conveyed from the fixing unit to the discharge roller 109 and then discharged out of the apparatus by the discharge roller 109, and is stacked on a discharge tray 110.

<Details of Conveyance Unit>

Figure 2:
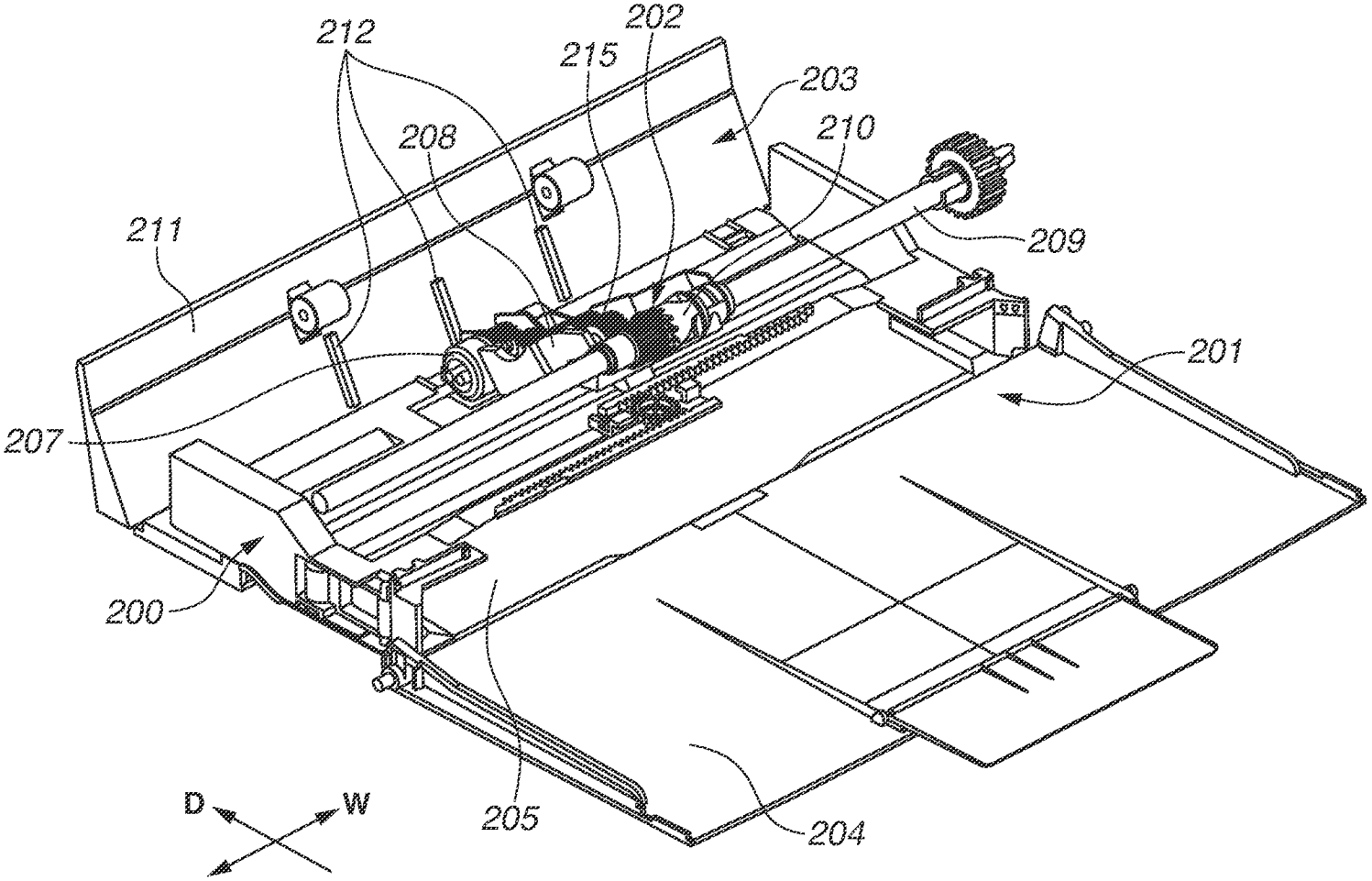
FIG. 2 is a perspective view schematically illustrating a conveyance unit according to the first exemplary embodiment.

A configuration of the conveyance apparatus 2 as a sheet storage device for storing sheets will be described below with reference to FIGS. 2 and 3. FIG. 2 is a perspective view schematically illustrating the conveyance apparatus 2.

The conveyance apparatus 2 includes a stacking unit 201, a feeding unit 202, and a separation unit 203. The stacking unit 201, capable of stacking the sheets P to be fed, includes a sheet tray 204 as a first stacking member and a stacking plate 205 as a second stacking member disposed on the apparatus main body 1.

The stacking plate 205 formed of, for example, a sheet metal is attached to the apparatus main body 1. The feeding unit 202 includes a feeding roller 207, an arm member 208 holding the feeding roller 207 and a drive member 215, a drive shaft 209, and a one-way clutch 210. The separation unit 203 includes a conveyance slope 211 and separation members 212.

Figure 3:
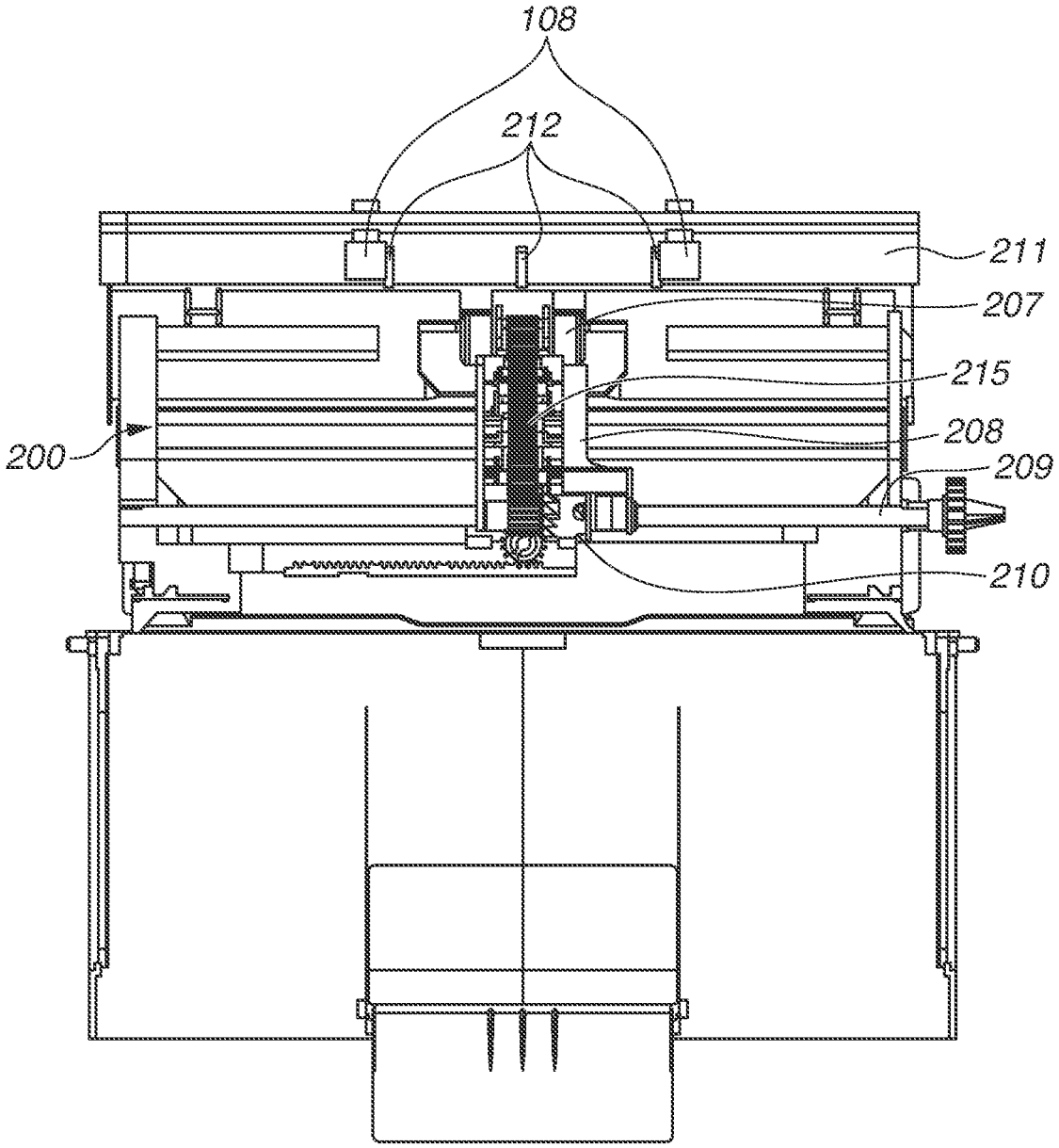
FIG. 3 is a top view schematically illustrating the conveyance unit according to the first exemplary embodiment.

FIG. 3 is a top view schematically illustrating the conveyance apparatus 2. The arm member 208 is rotatably supported by the drive shaft 209. The arm member 208 rotatably supports the feeding roller 207 and the drive member 215. The one-way clutch 210 is disposed between the drive shaft 209 and the drive member 215. When the sheet P is conveyed, a driving force is transmitted from the drive shaft 209 to the feeding roller 207 via the drive member 215. When the sheet P is inserted into the stacking unit 201, since the drive connection with a drive source (not illustrated) is released by the one-way clutch 210, the feeding roller 207 smoothly rotates without disturbing the insertion of the sheet P.

After inserted into the stacking unit 201, the sheets P push up the feeding roller 207 and then stop at a position where the leading edge of the sheets P abuts against the conveyance slope 211. When the insertion of the sheets P is completed, the feeding roller 207 is in contact with the surface of the sheet P by the weight of the feeding roller 207 itself. When a signal to start printing is sent to the apparatus main body 1, the feeding roller 207 is rotated by a drive system (not illustrated) including a motor. The feeding roller 207 conveys the stacked sheet P to the separation members 212. Projection shapes are formed on the separation members 212. When the leading edge of the sheet P is caught by the projection shapes of the separation members 212, only the uppermost sheet P is separated from a plurality of the sheets P and then conveyed to a conveyance roller pair 108 along the conveyance slope 211.

<Configuration of Regulation Unit>

Figure 4:
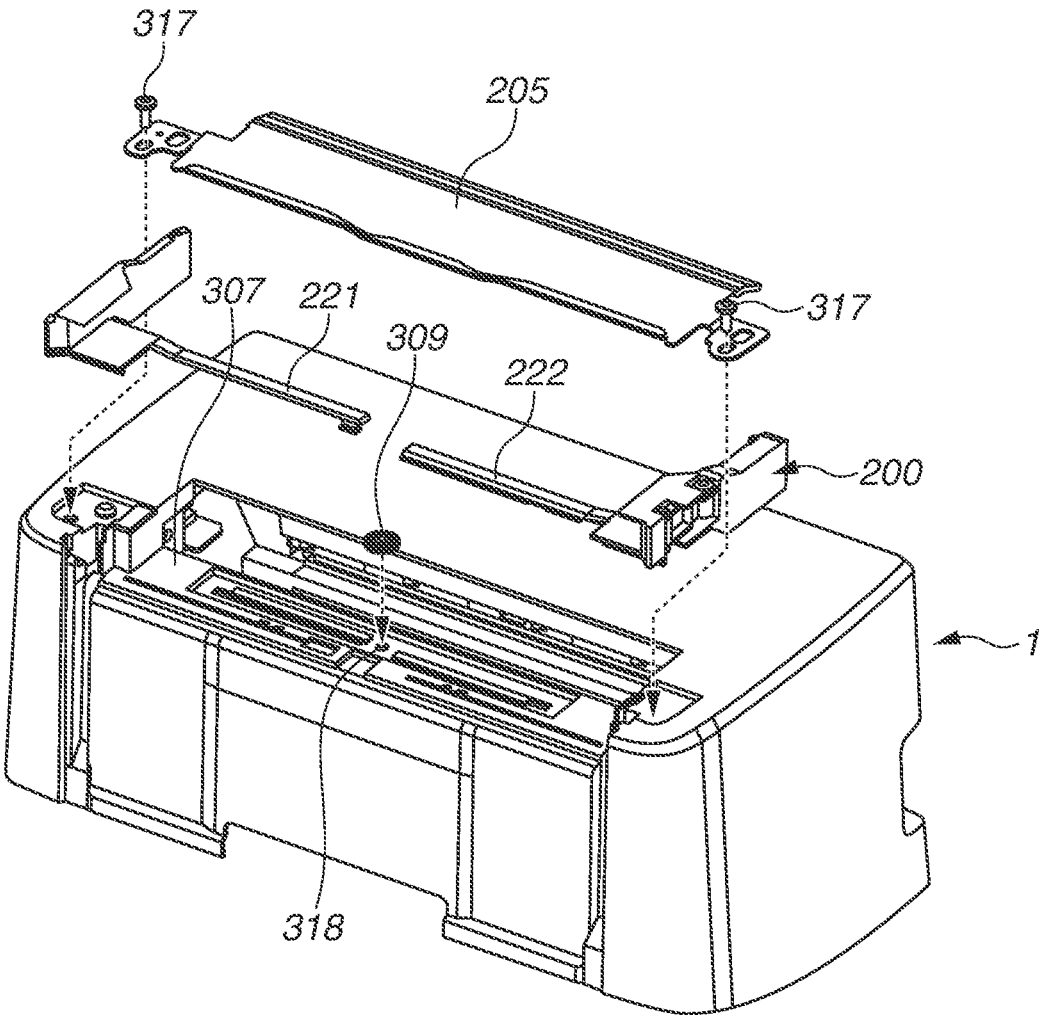
FIG. 4 is an exploded perspective view illustrating a regulation unit according to the first exemplary embodiment.
Figure 5:
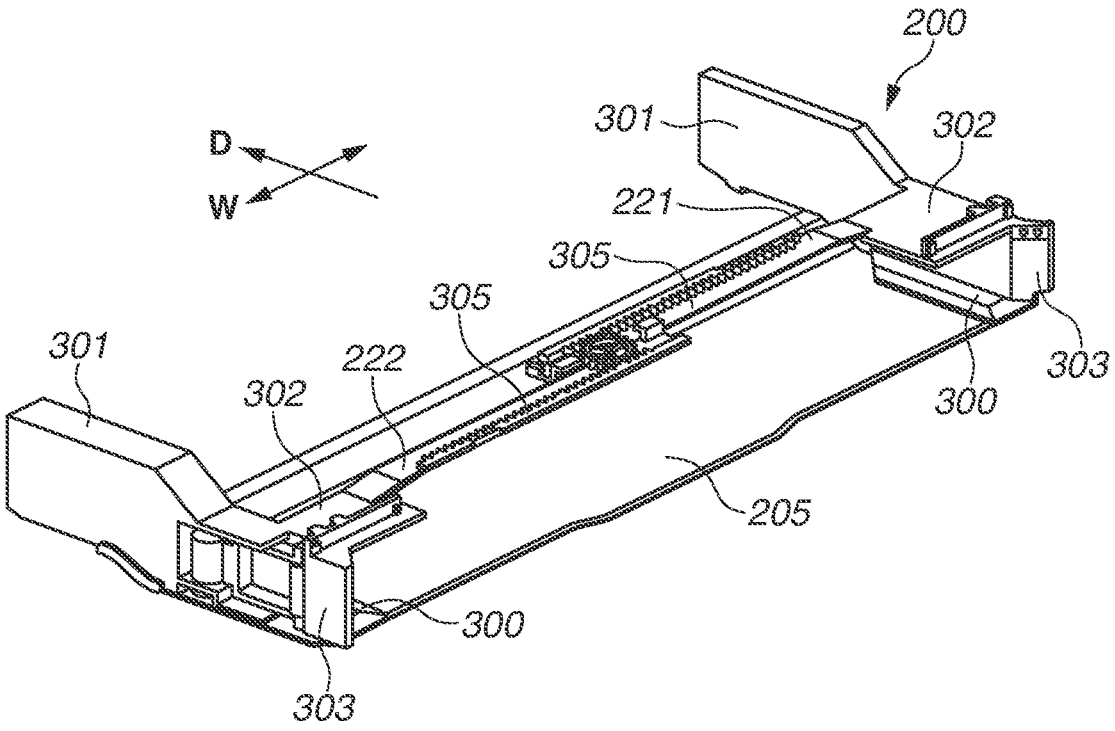
FIG. 5 is a perspective view illustrating the regulation unit installed to an apparatus main body.

A regulation unit 200 illustrated in FIGS. 2 and 3 will be described below with reference to FIGS. 4 and 5. The regulation unit 200 is movably installed to the apparatus main body 1 to regulate the edge position of the sheet P. FIG. 4 is an exploded perspective view illustrating the regulation unit 200. FIG. 5 is a perspective view illustrating the regulation unit 200 installed to the apparatus main body 1.

FIG. 4 is an exploded perspective view illustrating the apparatus main body 1 viewed from the bottom face side. The stacking plate 205 provided on the apparatus main body 1 is fixed to the apparatus main body 1 with screws 317. The apparatus main body 1 is provided with a facing member 307 having a surface facing the stacking plate 205. After a pinion gear 309 and the regulation unit 200 are attached to the facing member 307 of the apparatus main body 1, the stacking plate 205 is attached to the apparatus main body 1 and then fixed with the screws 317. The regulation unit 200 is composed of a first regulation member 221 and a second regulation member 222. The first and the second regulation members 221 and 222 move in an interlocking manner via the pinion gear 309. The facing member 307, the pinion gear 309, and the regulation unit 200 are formed of synthetic resin. The facing member 307 is provided with a cylinder-shaped boss 318 (rotation shaft) to rotatably hold the pinion gear 309. The engagement hole provided at the center of the pinion gear 309 is engaged with the boss 318.

FIG. 5 is a perspective view illustrating the regulation unit 200 attached to the apparatus main body 1. Each of the first regulation member 221 and the second regulation member 222 of the regulation unit 200 is integrally formed with a width regulation portion 301, a first plate 302, a second plate 300, and an operation portion 303. According to the present exemplary embodiment, each of the width regulation portions 301 includes a surface which comes in contact with one edge of the sheets P to regulate the position of the one edge (the other edge) of the sheets P in the width direction W intersecting with the feeding direction of the sheet P. The first plates 302 and the second plates 300 extend from respective edges of the width regulation portions 301 in parallel to the sheets P. The first plates 302 are disposed at the respective edges on the side of the facing member 307, and the second plates 300 are disposed at the respective edges on the side of the stacking plate 205. When the sheets P are placed on the stacking unit 201, the sheets P are stacked not only on the sheet tray 204 but also on the stacking plate 205. In this case, the second plates 300 are positioned between the sheets P and the stacking plate 205 and loaded with the sheets P together with the stacking plate 205. The second plates 300 are set to the same height as the sheet tray 204.

The operation portions 303 are disposed at the respective edges on the upstream side of the width regulation portions 301 in the conveyance direction D of the sheet P. The operation portions 303 are provided to be operated by the user. The first regulation member 221 and the second regulation member 222 are disposed to face each other, and the first plate 302 for each of them is provided with a rack portion 305 that is engaged with the pinion gear 309 as an interlocking member. If either one of the first regulation member 221 and the second regulation member 222 is moved via the pinion gear 309, the other regulation member can be moved in an interlocking manner. This makes it possible to regulate and settle the position of the sheet P in the width direction W from both sides.

Figure 6A:
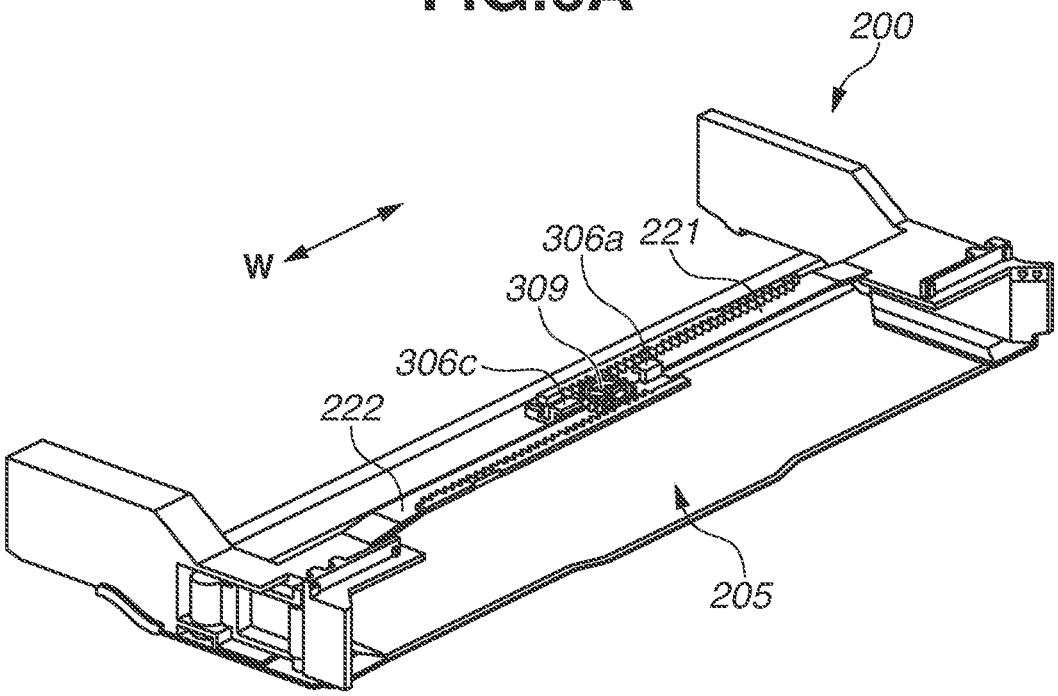
FIG. 6A is a perspective view illustrating a guide configuration of the regulation unit.
Figure 6B:
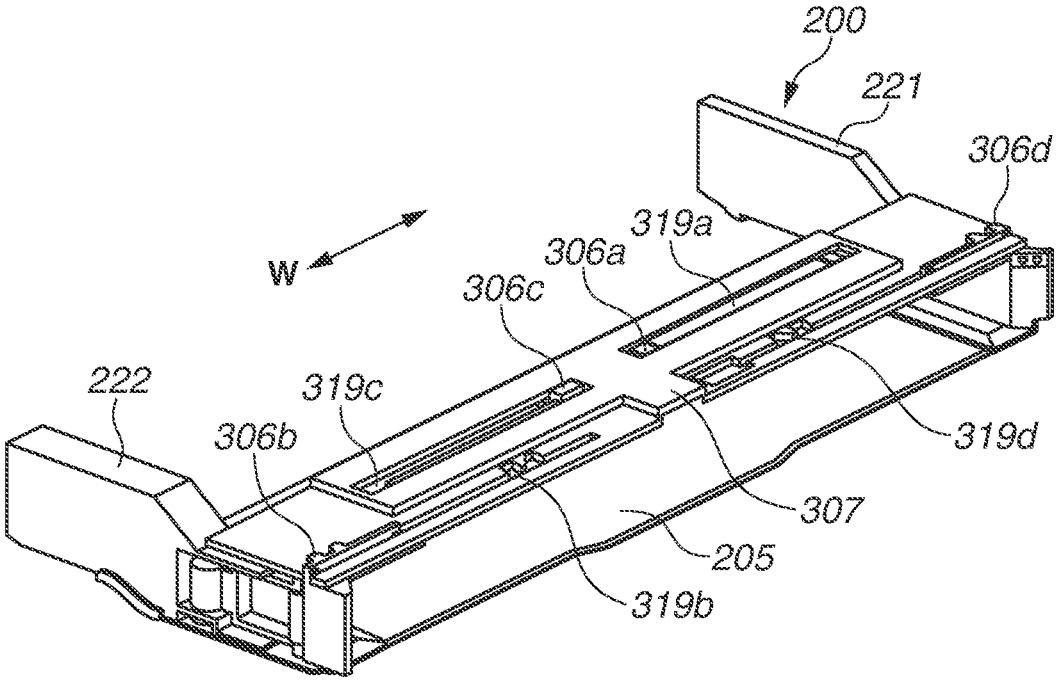
FIG. 6B is a perspective view illustrating an engagement state of the regulation unit and the apparatus main body.

FIG. 6A is a perspective view illustrating a guide configuration of the regulation unit 200, and FIG. 6B is a perspective view illustrating an engagement state between the regulation unit 200 and the apparatus main body 1. The first regulation member 221 is provided with a first guided portion 306*c*, and the second regulation member 222 is provided with a second guided portion 306*a*. The facing member 307 is provided with a first insertion hole 319*c* and a second insertion hole 319*a* at positions corresponding to the first guided portion 306*c* and the second guided portion 306*a*, respectively. The facing member 307 is further provided with a third insertion hole 319*b* and a fourth insertion hole 319*d*. The first regulation member 221 is guided by the first insertion hole 319*c* and the fourth insertion hole 319*d* to be slidably moved in the width direction W. Likewise, the second regulation member 222 is guided by the second insertion hole 319*a* and the third insertion hole 319*b* to be slidably moved in the width direction W. The first insertion hole 319*c*, the second insertion hole 319*a*, the third insertion hole 319*b*, and the fourth insertion hole 319*d* configure a guide hole serving as a guide portion for guiding the movement of the regulation unit 200 in the width direction.

Figure 7:
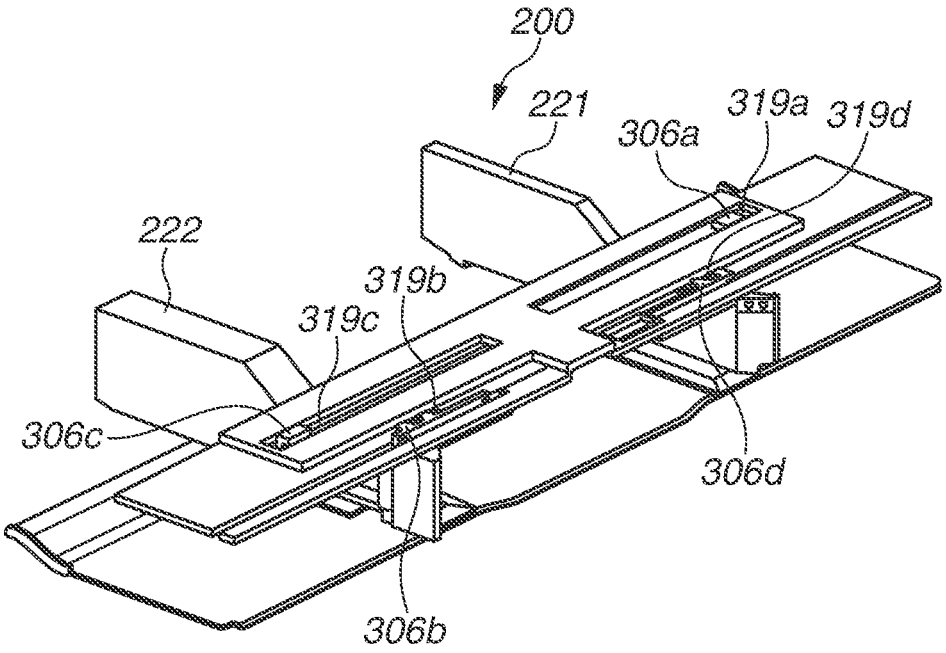
FIG. 7 is a perspective view illustrating an engagement state of the regulation unit and the apparatus main body.

FIG. 7 is a perspective view illustrating an engagement state between the regulation unit 200 and the apparatus main body 1. In the engagement state illustrated in FIG. 6B, the position of the regulation unit 200 in the width direction is determined corresponding to the large size set to the apparatus main body 1. On the other hand, in FIG. 7, the position of the regulation unit 200 in the width direction is determined corresponding to the small size set to the apparatus main body 1.

<Inclination Regulation Members for Regulation Unit 200>

The second regulation member 222 of the regulation unit 200 is provided with a stopper member 310 for restricting the inclination when the regulation unit 200 is operated. The stopper member 310 is configured as a separate member of the main part of the regulation unit 200.

The stopper member 310 is an inclination regulation member formed of synthetic resin having good sliding characteristics, such as polyacetal resin (POM).

Figure 8:
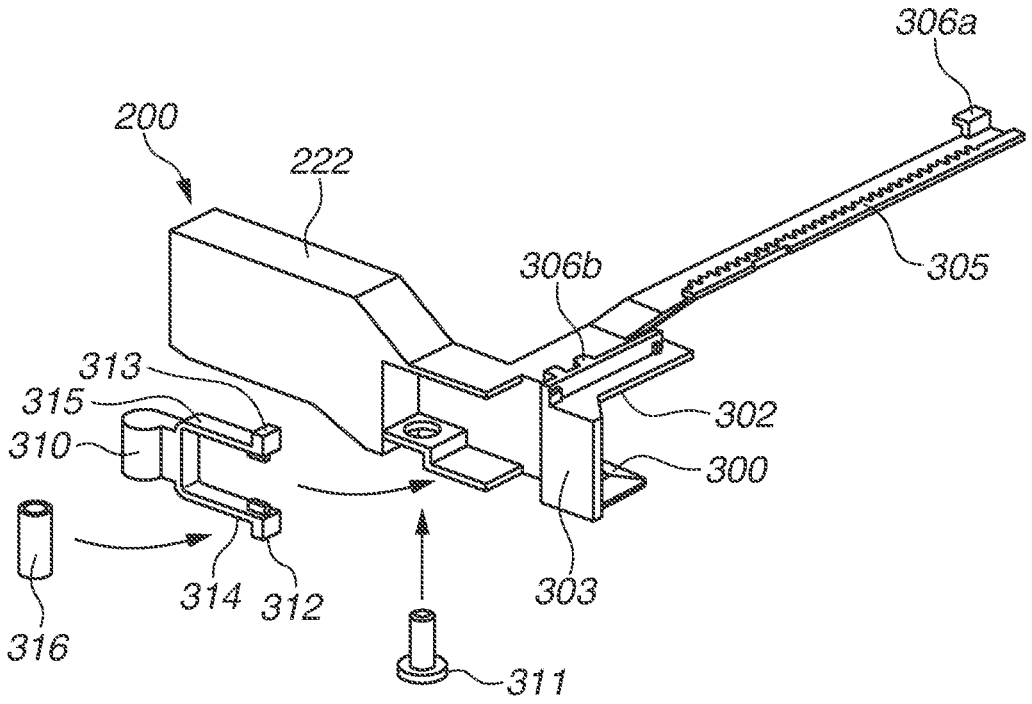
FIG. 8 is an exploded perspective view illustrating a stopper member according to the first exemplary embodiment.

FIG. 8 is an exploded perspective view illustrating the stopper member 310. The stopper member 310 is disposed between the first plate 302 and the second plate 300, on the outer side of the sheet P and the width regulation portion 301 in the width direction W, and is fastened and fixed to the second regulation member 222, for example, with a screw 311. The stopper member 310 may be configured to be bonded to the second regulation member 222. The stopper member 310 is provided with a first hook 314 as a first urging portion and a second hook 315 as a second urging portion. The tip of the first hook 314 is provided with an integrally formed first contact portion 312, and the tip of the second hook 315 is provided with an integrally formed second contact portion 313. An urging member 316, such as a metallic compression spring, is disposed between the first contact portion 312 and the second contact portion 313. The first hook 314 and the second hook 315 are formed in shapes which are easily elastically deformed by the urging member 316.

Figure 9:
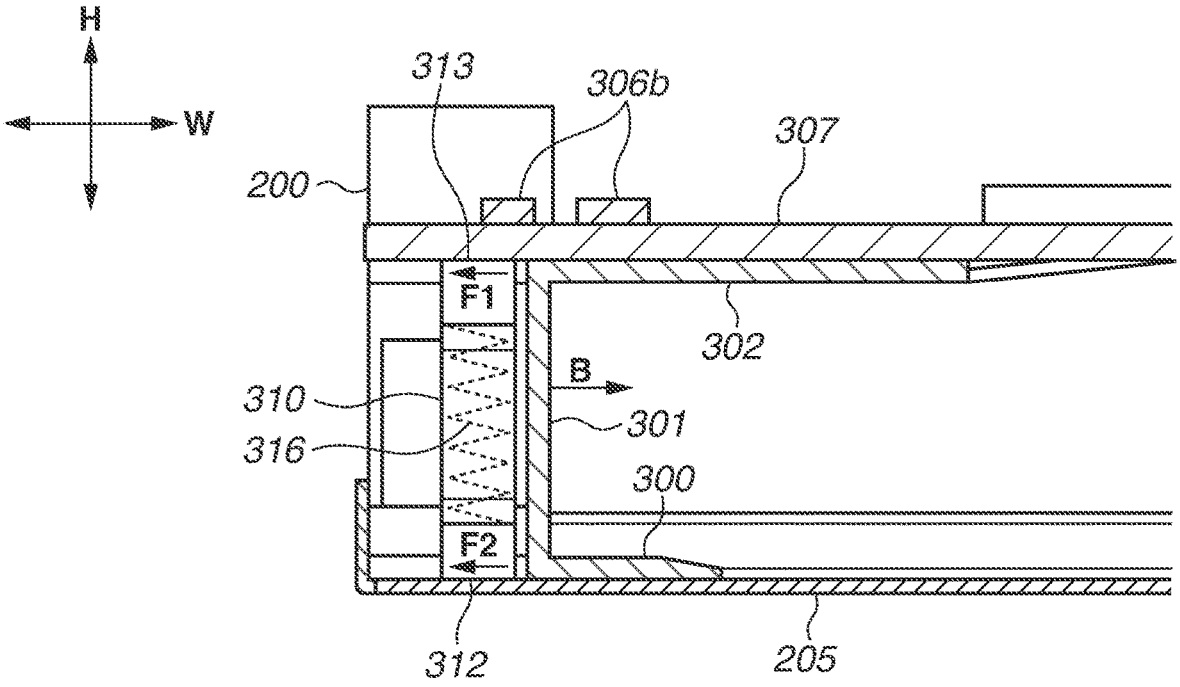
FIG. 9 is a cross-sectional view illustrating contact portions according to the first exemplary embodiment.

FIG. 9 is a cross-sectional view illustrating the stopper member 310. According to the present exemplary embodiment, the first contact portion 312 contacts the stacking plate 205, and the second contact portion 313 contacts the facing member 307 in a state of being urged by a predetermined urging force in a sheet stacking direction H perpendicularly intersecting with the DW plane illustrated in FIG. 3. The urging direction for each contact portion is parallel to the sheet stacking direction. Therefore, the urging force has a small influence on the inclination of the second regulation member 222 in the width direction. The first contact portion 312 and the second contact portion 313 are configured to balance while being applied with forces having approximately the same magnitude. This configuration makes it possible, even if a reaction force is applied by each contact portion, to prevent the second regulation member 222 from being pressed by the reaction force with a guided portion 306*b* as a fulcrum, to prevent the inclination of the orientation of the second regulation member 222 in the sheet stacking direction H.

When the regulation unit 200 is to be moved, the operation portion 303 is applied with an operation force B, and retention forces F2 and F1 are generated by friction at the first contact portion 312 and the second contact portion 313, respectively. When the first contact portion 312 serves as a fulcrum, the moment by the retention force F1 acting on the second contact portion 313 acts in the opposite direction, which prevents the inclination of the orientation of the regulation unit 200. Also, when the second contact portion 313 serves as a fulcrum, the inclination of the orientation of the second regulation member 222 can be similarly prevented by the retention force F2 acting on the first contact portion 312.

Even when the second regulation member 222 is being moved, the retention forces F2 and F1 are acting on the first contact portion 312 and the second contact portion 313, respectively, against the operation force B. This makes it possible to move the second regulation member 222 without inclining the orientation of the second regulation member 222.

Although, in the present exemplary embodiment, the guided portion 306 is disposed on the first plate 302 and the guide hole is disposed on the facing member 307, the guided portion 306 may be disposed on the second plate 300 and the guide hole may be disposed on the apparatus main body 1 on the stacking plate 205 side.

Although, in the present exemplary embodiment, the second regulation member 222 is provided with the first contact portion 312 and the second contact portion 313, the first regulation member 221 may be provided with the first contact portion 312 and the second contact portion 313 or both regulation members may be provided with the first contact portion 312 and the second contact portion 313.

According to the present exemplary embodiment, a pair of regulation members 221 and 222 are interlocked by using the rack portion 305 and the pinion gear 309. However, only one regulation member 221 or 222 may be movably disposed, and the one movable regulation member 221 or 222 may be provided with the first contact portion 312 and the second contact portion 313.

Although, in the present exemplary embodiment, the rack portion 305 and the pinion gear 309 for interlocking the pair of regulation members 221 and 222 are disposed on the facing member 307, the rack portion 305 and the pinion gear 309 may be disposed on the side of the stacking plate 205.

Although, in the present exemplary embodiment, a metallic compression spring as the urging member 316 for providing urging forces is disposed between the first contact portion 312 and the second contact portion 313, the configuration is not limited thereto. For example, the first contact portion 312 and the second contact portion 313 may be provided at the hook-shaped tips, and by contacting the first contact portion 312 and the second contact portion 313 respectively with the stacking plate 205 and the facing member 307 to bend the hook-shaped portion. In this case, the urging member 316 can be eliminated by urging the tips by the elastic force produced by the hook shapes being bent.

An image forming apparatus according to a second exemplary embodiment of the present invention will be described below with reference to FIGS. 10 and 11. The configurations of the image forming apparatus, the conveyance apparatus 2, and the regulation unit 200 according to the present exemplary embodiment are similar to the configurations according to the first exemplary embodiment, and therefore descriptions thereof will be made using the same reference numerals.

Figure 10:
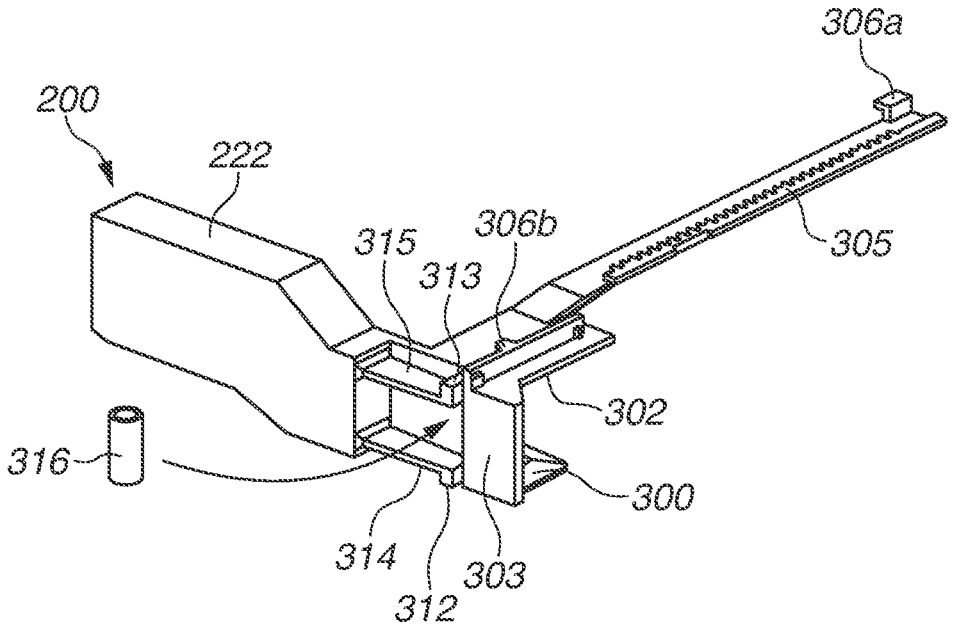
FIG. 10 is an exploded perspective view illustrating a regulation unit according to a second exemplary embodiment.
Figure 11:
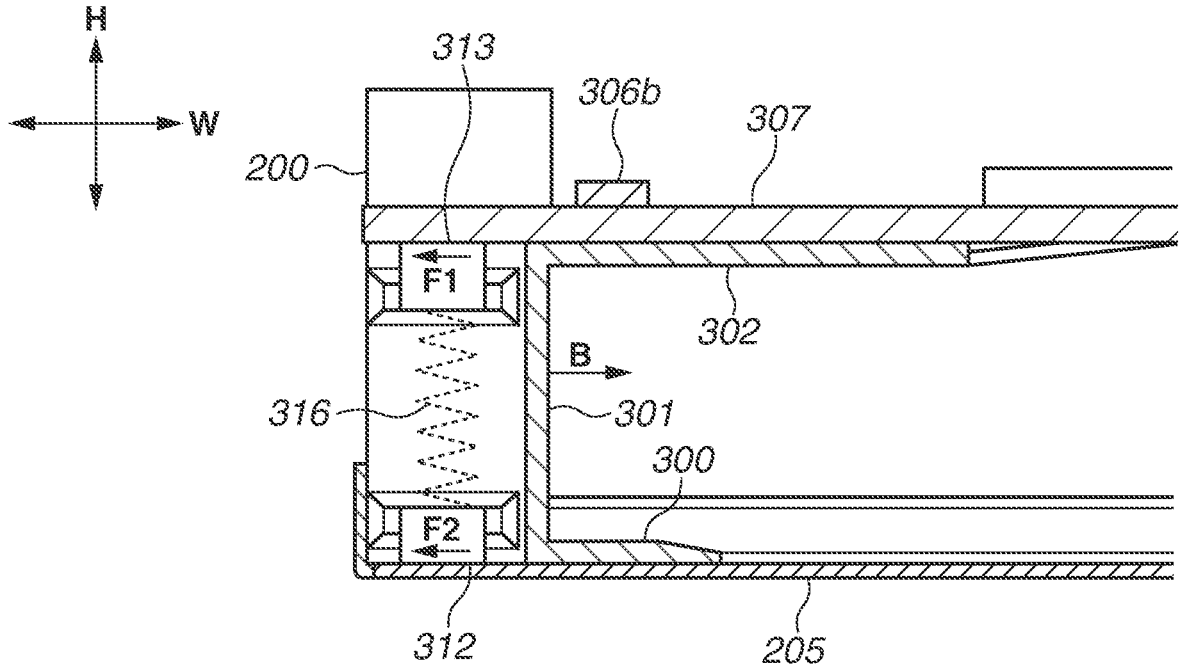
FIG. 11 is a cross-sectional view illustrating contact portions according to the second exemplary embodiment.

FIG. 10 is an exploded perspective view illustrating a configuration of contact portions for generating the retention forces of the regulation unit 200. The second regulation member 222 is provided with an integrally formed first hook 314 as a first urging portion, and an integrally formed second hook 315 as a second urging portion. The first regulation member 221 has a similar configuration thereto. The tip of the first hook 314 is provided with the first contact portion 312, and the tip of the second hook 315 is provided with the second contact portion 313.

The first hook 314 and the second hook 315 are formed on outer side of the sheet P and the width regulation portion 301 in the width direction W, and are formed in shapes easily elastically deformable in the sheet stacking direction H. The first contact portion 312 is disposed to contact the stacking plate 205, and the second contact portion 313 is disposed to contact the facing member 307.

The urging member 316, such as a metallic compression spring, is disposed between the first contact portion 312 and the second contact portion 313. FIG. 11 is a cross-sectional view illustrating contact portions of the regulation unit 200. The first contact portion 312 contacts the stacking plate 205, and the second contact portion 313 contacts the facing member 307, by respective predetermined urging forces in the sheet stacking direction H. Therefore, similar to the first exemplary embodiment, the urging force has a small influence with respect to the inclination of the regulation unit 200 in the width direction W.

The first contact portion 312 and the second contact portion 313 are configured to balance as forces having approximately the same magnitude are applied to the first contact portion 312 and the second contact portion 313. This configuration makes it possible, even if a reaction force is applied by each contact portion, to prevent the orientation of the regulation unit 200 from inclining in the sheet stacking direction H by being pressed by the reaction force with the guided portion 306*b* as a fulcrum. When the regulation unit 200 is to be moved, the operation portion 303 is applied with an operation force B, and retention forces F2 and F1 are generated by friction at the first contact portion 312 and the second contact portion 313, respectively. When the first contact portion 312 serves as a fulcrum, since the moment by the retention force F1 acting on the second contact portion 313 acts in the opposite direction, the inclination of the orientation of the regulation unit 200 can be restricted. Also, when the second contact portion 313 serves as a fulcrum, the inclination of the orientation of the regulation unit 200 can be similarly prevented by the retention force F2 acting on the first contact portion 312.

Even when the regulation unit 200 is being moved, the retention forces F2 and F1 are acting on the first contact portion 312 and the second contact portion 313, respectively, against the operation force B. This makes it possible to move the regulation unit 200 without inclining the orientation of the regulation unit 200. The number of parts can be reduced by integrally forming the first hook 314 and the second hook 315 with the regulation unit 200.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus, comprising:

an apparatus main body;

a stacking unit disposed on the apparatus main body and configured to stack sheets;

a regulation unit configured to move with respect to the apparatus main body, and to regulate edge positions of the sheets to be stacked on the stacking unit; and a supporting member configured to support the regulation unit and placed above the sheets to be stacked on the stacking unit, wherein the regulation unit includes a first regulation member configured to move in a width direction of the sheets to be stacked on the stacking unit and to contact one edge of the sheets to regulate the edge position of the sheets in a width direction;

a second regulation member configured to contact an other edge of the sheets to regulate the edge position of the sheets, and a pinion gear configured to rotate about a rotation shaft disposed on the supporting member, wherein the first regulation member includes a first contact member configured to contact the stacking unit and contact the supporting member in a state of being urged toward both the stacking unit and the supporting member, and wherein the second regulation member includes a second contact member configured to contact the stacking unit and contact the supporting member in a state of being urged toward both the stacking unit and the supporting member.

2. The image forming apparatus according to claim 1, wherein the first regulation member and the second regulation member move in opposite directions via the pinion gear.

3. The image forming apparatus according to claim 1, wherein the first contact member is a separate member from the first regulation member.

4. The image forming apparatus according to claim 3, wherein the second contact member is a separate member from the second regulation member.

5. The image forming apparatus according to claim 3, wherein the first contact member includes an elastically deformable first contact portion configured to contact the stacking unit and an elastically deformable second contact portion configured to contact the supporting member.

6. The image forming apparatus according to claim 5, wherein the second contact member includes an elastically deformable third contact portion configured to contact the stacking unit and an elastically deformable fourth contact portion configured to contact the supporting member.

7. The image forming apparatus according to claim 1, wherein the supporting member includes a first guide portion configured to guide a movement of the first regulation member in the width direction.

8. The image forming apparatus according to claim 1, wherein the supporting member includes a second guide portion configured to guide a movement of the second regulation member in the width direction.

9. The image forming apparatus according to claim 8, wherein the first and the second regulation members are movable in the width direction in a state of being sandwiched between the stacking unit and the supporting member.

10. The image forming apparatus according to claim 9, wherein a movement of the first regulation member and a movement of the second regulation member are interlocked by the pinion gear.

11. The image forming apparatus according to claim 1, wherein each of the first and the second regulation members includes an operation portion configured to be operated to move each of the first and the second regulation members in the width direction.

* * * * *